US011279514B1

(12) United States Patent
Chen

(10) Patent No.: US 11,279,514 B1
(45) Date of Patent: Mar. 22, 2022

(54) FOLDABLE BASKET

(71) Applicant: PROTREND CO., LTD., Taipei (TW)

(72) Inventor: Henry Chen, Taipei (TW)

(73) Assignee: PROTREND CO., LTD., Taipei (TW)

( * ) Notice: Subject to any disclaimer, the term of this patent is extended or adjusted under 35 U.S.C. 154(b) by 0 days.

(21) Appl. No.: 17/169,590

(22) Filed: Feb. 8, 2021

(51) Int. Cl.

| | |
|---|---|
| ***B65D 6/18*** | (2006.01) |
| ***B65D 21/08*** | (2006.01) |
| ***B65D 25/10*** | (2006.01) |
| ***B65D 25/00*** | (2006.01) |

(52) U.S. Cl.
CPC ..... *B65D 11/182* (2013.01); *B65D 21/086* (2013.01); *B65D 25/005* (2013.01); *B65D 25/108* (2013.01)

(58) Field of Classification Search
CPC .. B65D 11/182; B65D 21/086; B65D 25/108; B65D 11/1833; B65D 11/184; B65D 11/1846; B65D 11/1853; B65D 11/186; B65D 25/005
USPC ..... 220/6, 7
See application file for complete search history.

(56) References Cited

U.S. PATENT DOCUMENTS

| | | | | |
|---|---|---|---|---|
| 4,192,430 A * | 3/1980 | Cornou | B65D 19/18 220/1.5 |
| 4,630,745 A * | 12/1986 | Shiotani | B65D 11/182 217/15 |
| 4,917,255 A * | 4/1990 | Foy | B65D 25/005 220/6 |
| 2011/0215105 A1* | 9/2011 | Dubois | B65D 11/18 220/682 |

* cited by examiner

*Primary Examiner* — Andrew D Perreault
(74) *Attorney, Agent, or Firm* — WPAT, PC

(57) ABSTRACT

A foldable basket consisting of one bottom piece, one upper frame, one front wall, one rear wall, one left wall, and one right wall. The lower ends of the left and right walls are pivot-connected to the bottom piece. The upper ends of the front and rear walls are pivot-connected to the upper frame. The upper frame is located outside the left wall and the right wall, and can move up and down along the left wall and the right wall. The upper frame, the left wall and the right wall form as one body. The bottom piece, the front wall and the rear wall form as one body. There is a door installed on the front wall. The door downwards to reveal the interior of the foldable basket.

9 Claims, 14 Drawing Sheets

FOLDABLE BASKET

TECHNICAL FIELD

This invention discloses a foldable basket which can be folded flat and also expanded to serve as a standing basket.

BACKGROUND

In the logistics industry, plastic baskets are frequently used to carry items. The plastic baskets can be categorized into "fixed baskets" and "foldable baskets." A fixed basket remains its volume even when not in used, which makes it occupy too much space in storage. On the contrary, a foldable basket can be folded flat when not in use, which leads to significant volume reduction. Thus, multiple baskets can be folded flat and stacked on one another for convenience.

Plastic foldable baskets commonly seen in the market mostly consist of a bottom piece, an upper frame, a front wall, a rear wall, a left wall, and a right wall. The upper and lower ends of the front and rear walls are pivot-connected to the bottom piece and the upper frame. The lower ends of the left and right walls are pivot-connected to the bottom piece. The upper ends of the left and right walls are snapped to the upper frame, which forms a basket. There is a horizontally extending pivot on the front wall and the rear wall. The pivot serves as an axis allowing the front and rear walls to fold in half.

To fold the above-mentioned commonly seen baskets, the upper ends of the left and right walls are detached from the upper frame, and placed lying. Then, the front and rear walls can be folded flat in half. This allows the upper frame to descend and stack on the bottom piece. During this step, the front and rear walls offer a more complex folding sequence with inconsistent accuracy, making the operation more difficult. Furthermore, such foldable baskets are stacked on one another when carrying items. In order to reach the item in a basket, one has to remove the baskets on top to reveal the upper opening of the wanted basket. The removed baskets also need to be put back in place afterwards. This makes accessing items quite a hassle.

SUMMARY OF THE INVENTION

This invention discloses a foldable basket which expands or folds using a moving upper frame. Also, the four walls are each made with a single piece to increase the rigidity of the foldable basket.

This invention discloses a foldable basket with a door that opens and allows one to reach or put items inside without removing the baskets stacked on top.

This foldable basket consists of one bottom piece, one upper frame, one front wall, one rear wall, one left wall, and one right wall. There is a first convex wall on the front end of the bottom piece, a second convex wall on the rear end, a third convex wall on the left end, and a fourth convex wall on the right end. The lower end of the left wall is engaged with the third convex wall and are pivot-connected. The lower end of the right wall is engaged with the fourth convex wall and are pivot-connected. The upper frame is located outside the left wall and the right wall, and can move up and down along the left wall and the right wall. The upper end of the front wall and the front end of the upper frame are pivot-connected. The upper end of the rear wall and the rear end of the upper frame are pivot-connected. The upper frame, the left wall and the right wall form as one body. The bottom piece, the front wall and the rear wall form as one body.

The front wall consists of one front wall frame and one door. There is an opening in the center of the front wall frame. There is a protruding pivot on each bottom end of the door. The central opening on the front wall frame has a long hole on both sides. The two protruding pivots of the door are inserted into the long holes. The opening on the front wall frame has a loop of doorstop which holds the door. The door opens downwards to reveal the interior of the foldable basket.

The doorstop of the front wall frame has two hook grooves. There are two hooks inside the door correspondingly. The hooks are attached in a top-down manner to the hook grooves, locking the door in an upright position.

The front wall frame has a stopping plate on the left and right sides. This stops the door from moving outwards. The door has corresponding recesses for the stopping plates. The height of the recesses is lower than the stopping plates. Lifting the door upwards, the recesses are aligned to the stopping plates, allowing the stopping plates to pass through.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DESCRIPTION OF PREFERRED EMBODIMENT

Figure 1:
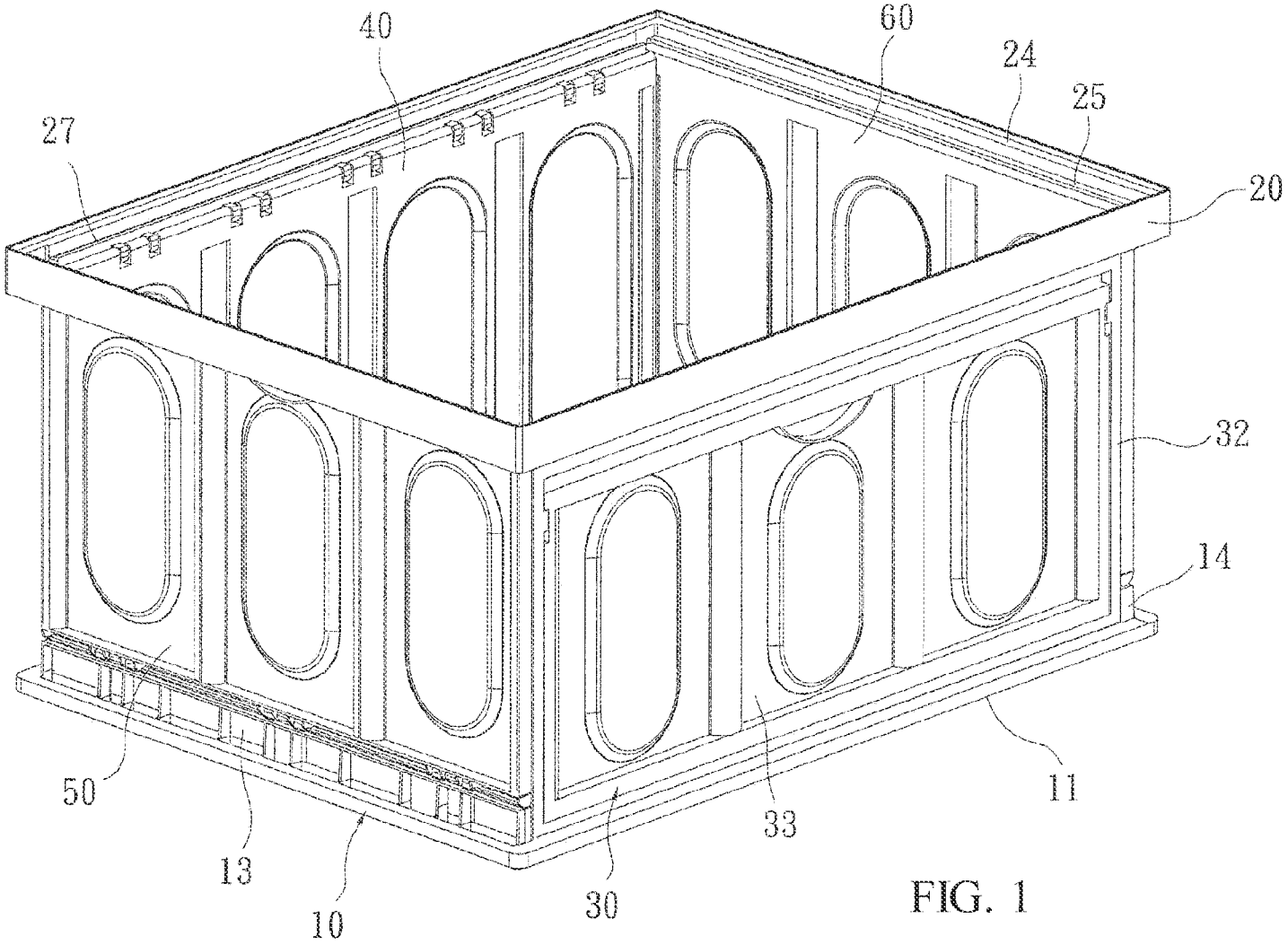
FIG. 1 is the exterior drawing of an embodiment of this invention.
Figure 2:
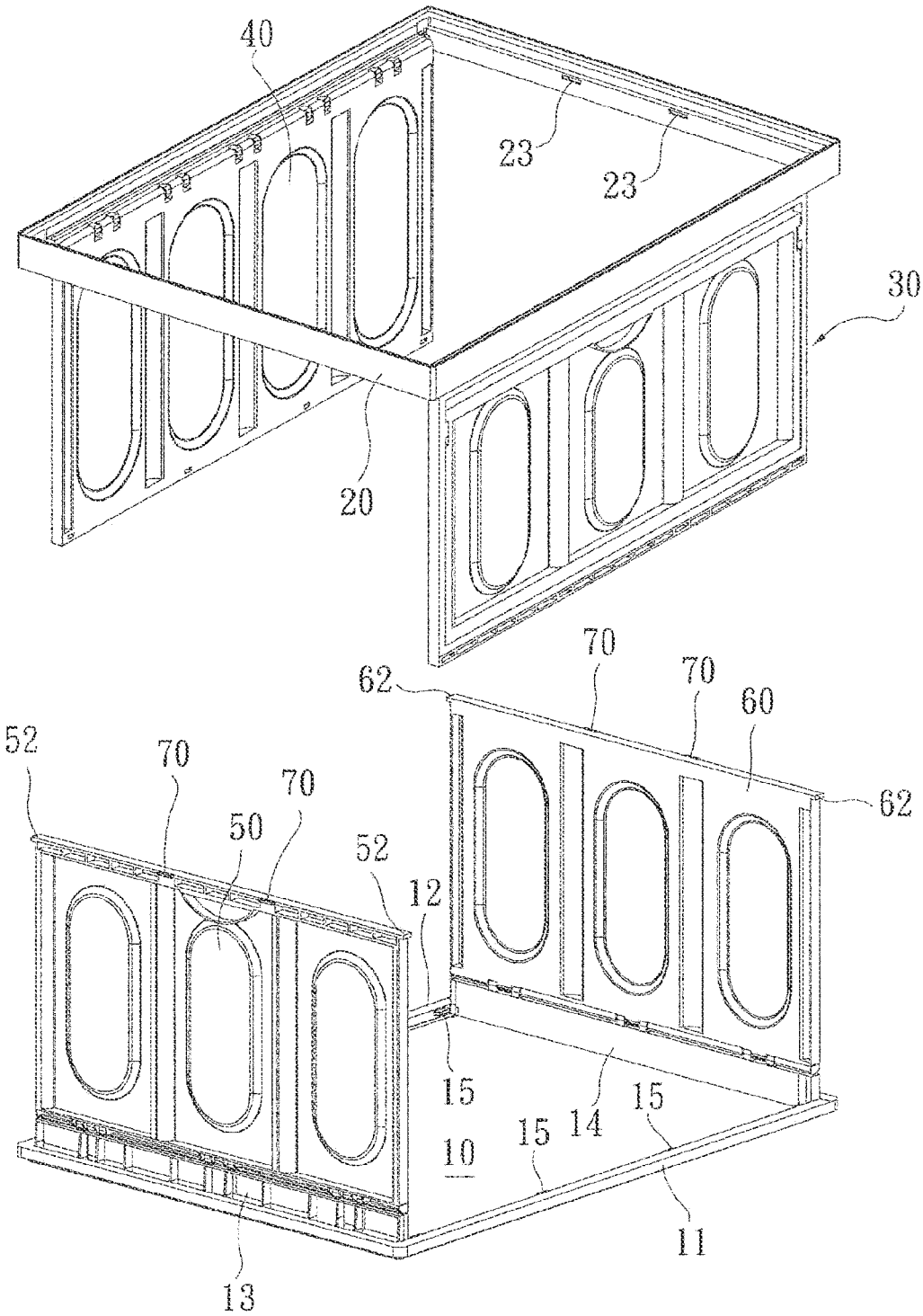
FIG. 2 is the breakdown drawing of the embodiment shown in FIG. 1.
Figure 3:
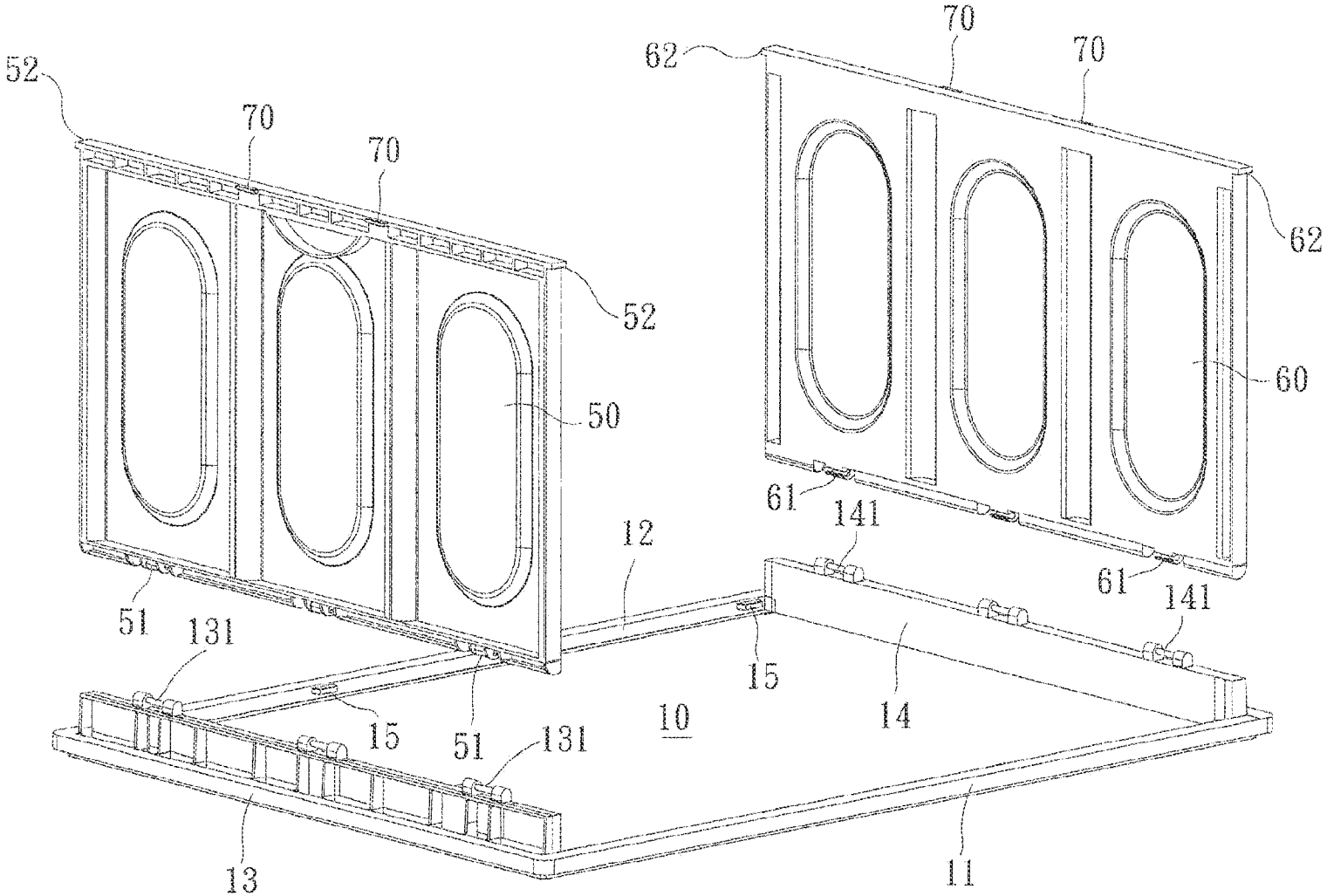
FIG. 3 is the breakdown drawing of the bottom piece, left wall, and right wall.
Figure 4:
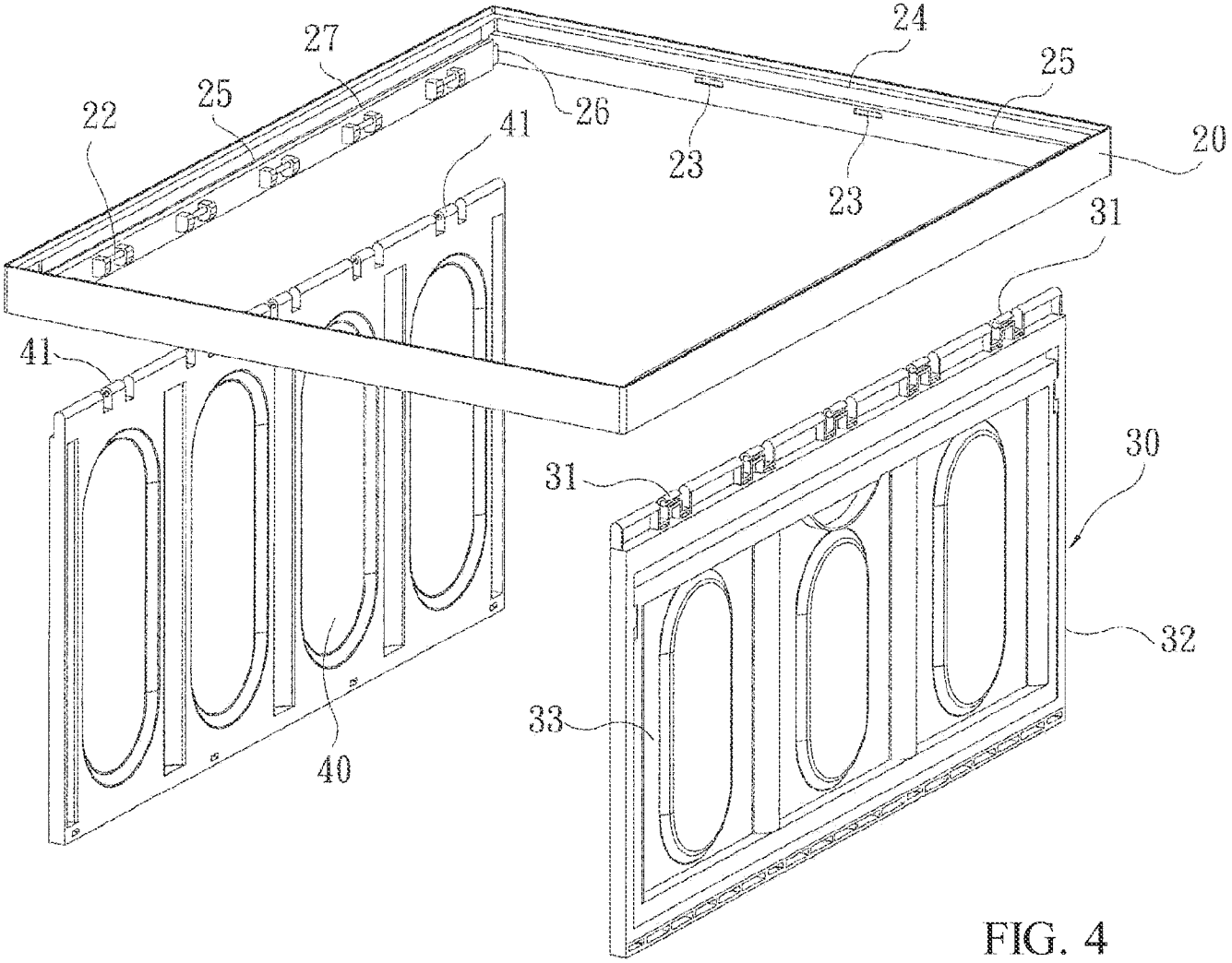
FIG. 4 is the breakdown drawing of the upper frame, front wall, and rear wall.

See FIGS. 1 to 4. The foldable basket disclosed in this invention can expand into a box shape to carry items or collapse flat for easy storage. This foldable basket consists of one bottom piece 10, one upper frame 20, one front wall 30, one rear wall 40, one left wall 50, and one right wall 60. There is a first convex wall 11 on the front end of the bottom piece 10, a second convex wall 12 on the rear end, a third convex wall 13 on the left end, and a fourth convex wall 14 on the right end. The first and second convex walls 11, 12 are at the same height and are across from each other. The third and fourth convex walls 13, 14 are at the same height and are across from each other. The third and fourth convex walls 13, 14 are taller than the first and second convex walls 11, 12. The lower end of the left wall 50 is engaged with the third convex wall 13 and the two are pivot-connected. The lower end of the right wall 60 is engaged with the fourth convex wall 14 and the two are pivot-connected.

The upper end of the third convex wall 13 of the bottom piece 10 has at least one co-axial pivot 131. Correspondingly, the lower end of the left wall 50 has at least one open pivot hole 51. Each pivot 131 can be inserted into the corresponding pivot hole 51. Thus, the left wall 50 can be moved with pivots 131 as an axis. In this embodiment, there are three pivots 131 and three pivot holes 51.

The upper end of the fourth convex wall 14 of the bottom piece 10 has at least one co-axial pivot 141. Correspondingly, the lower end of the right wall 60 has at least one open pivot hole 61. Each pivot 141 can be inserted into the corresponding pivot hole 61. Thus, the right wall 60 can be moved with pivots 141 as an axis. In this embodiment, there are three pivots 141 and three pivot holes 61.

The upper frame 20 is located outside the left wall 50 and the right wall 60, and can move up and down along the left wall 50 and the right wall 60. In order to allow the upper frame 20 to move up and down, the left wall 50 and the right wall 60 should be expanded to an upright position.

The upper end of the front wall 30 and the front end of the upper frame 20 are pivot-connected. The upper end of the rear wall 40 and the rear end of the upper frame 20 are pivot-connected. There is at least one co-axial pivot 22 inside the rear frame bar of the upper frame 20. Correspondingly, the upper end of the rear wall 40 has at least one open pivot hole 41. Each pivot 22 can be inserted into the corresponding pivot hole 41. Thus, the rear wall 40 can expand to an upright position or collapse to a lying position with the pivots 22 as an axis. In this embodiment, there are five pivots 22 and five pivot holes 41.

There is at least one co-axial pivot (not shown in the Figures, equivalent to above-mentioned pivots 22) inside the front frame bar of the upper frame 20. Correspondingly, the upper end of the front wall 30 has at least one open pivot hole 31. Each pivot can be inserted into the corresponding pivot hole 31. Thus, the front wall 30 can expand to an upright position or collapse to a lying position with the pivots as an axis. In this embodiment, there are five pivots and five pivot holes 31.

There are at least two first rabbets 23 inside the left frame bar 50 and the right frame bar 60 of the upper frame 20 (the rabbets 23 of the left frame bar 50 not shown in Figures). Correspondingly, there are at least two first fasteners 70 outside the left wall 50 and the right wall 60. Inserting the first fasteners 70 into the corresponding first rabbets 23, the upper frame 20, the left wall 50 and the right wall 60 form as one body. The first convex wall 11 and the second convex wall 12 of the bottom piece 10 have at least two second fasteners 15. In this embodiment, there are four fasteners 15 inside the first convex wall 11 and the second convex wall 12. Correspondingly, there are at least two second rabbets 71 outside the front wall 30 and the rear wall 40 (the second rabbets outside the rear wall 40 not shown in Figures). Inserting the second fasteners 15 into the corresponding second rabbets 71, the front wall 30, the rear wall 40 and the bottom piece 10 form as one body.

Figure 5:
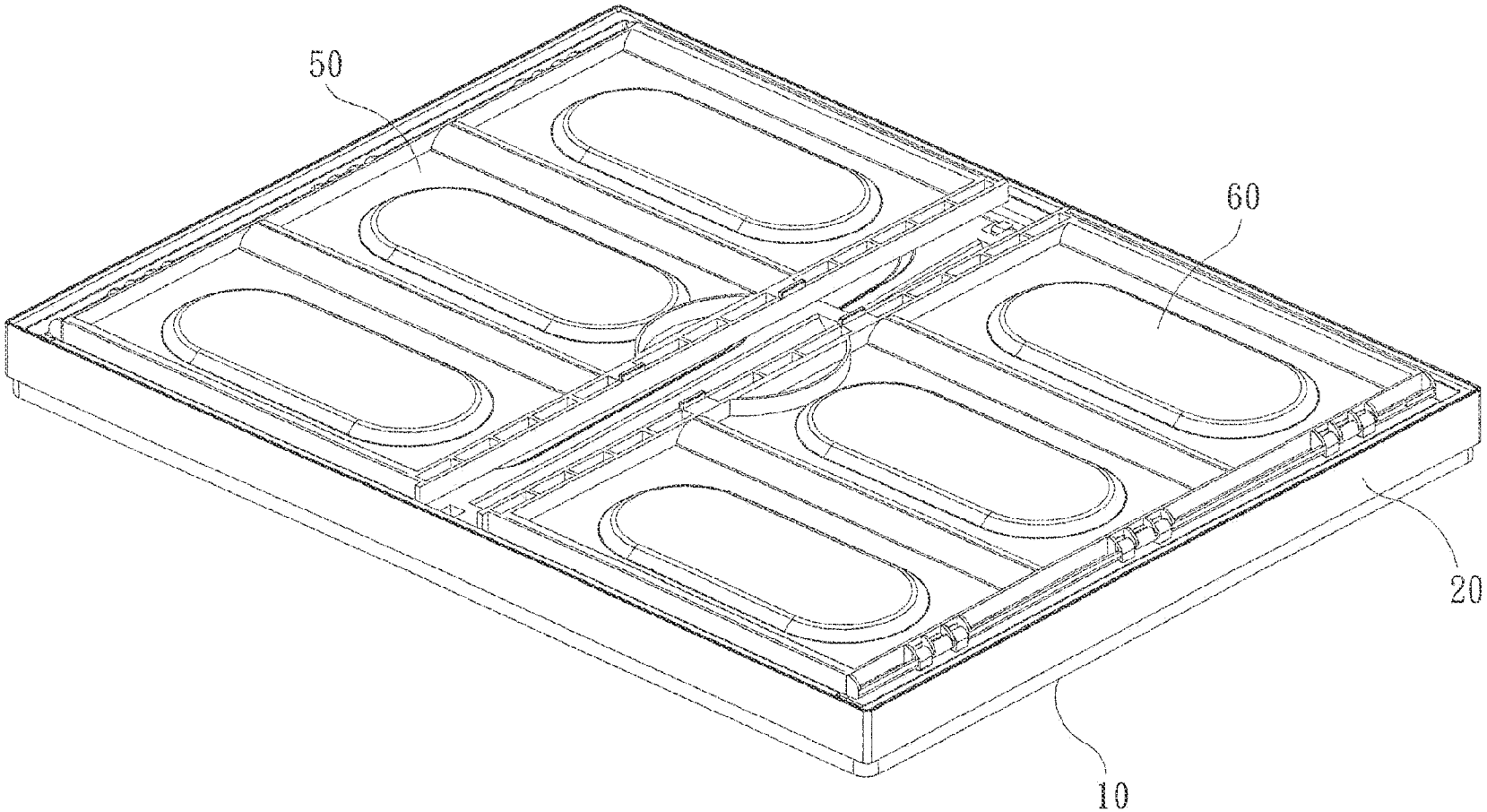
FIG. 5 demonstrates this embodiment when it is folded flat.
Figure 6:
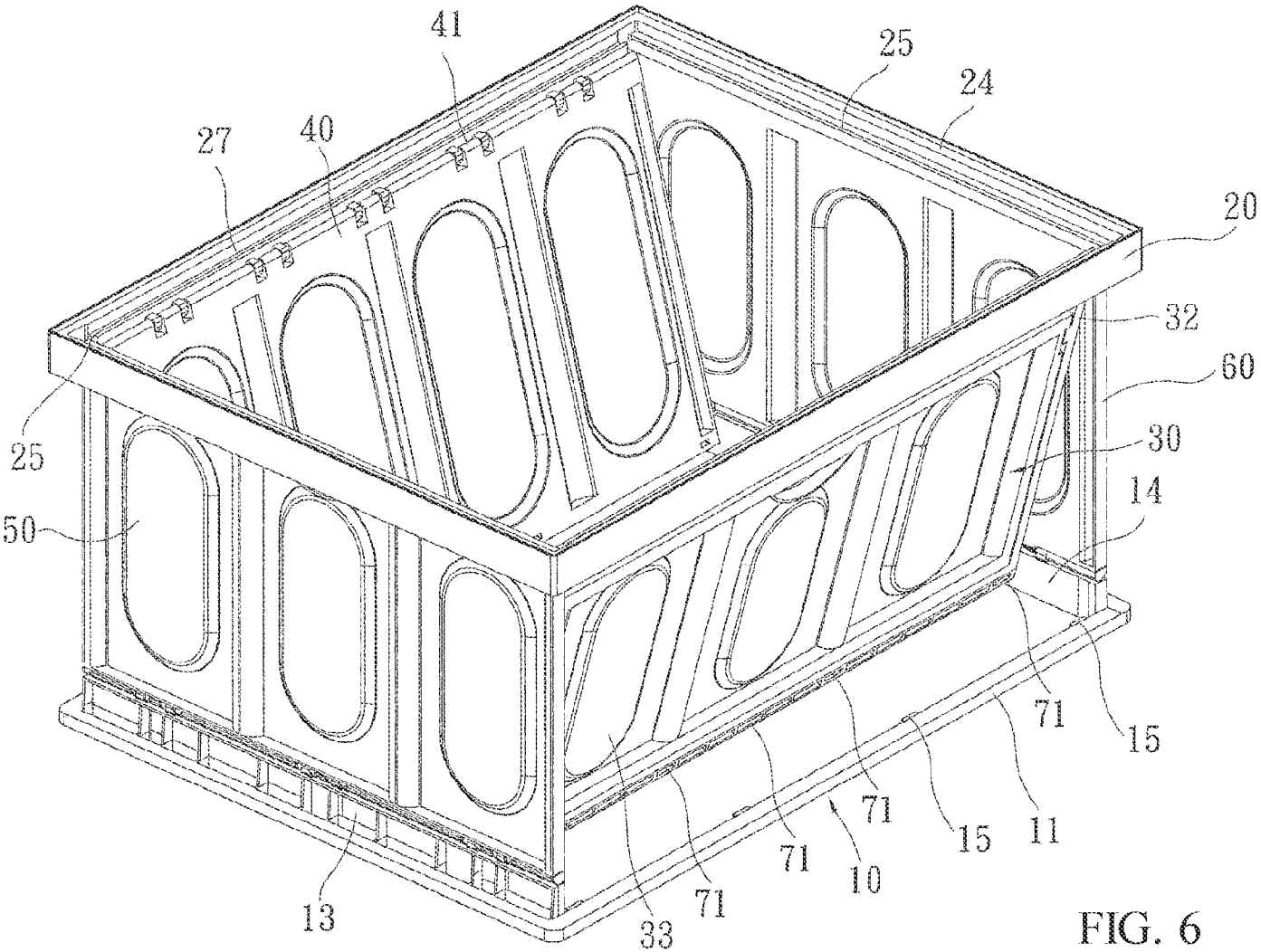
FIGS. 6 to 8 demonstrates the folding procedures of this embodiment.
Figure 7:
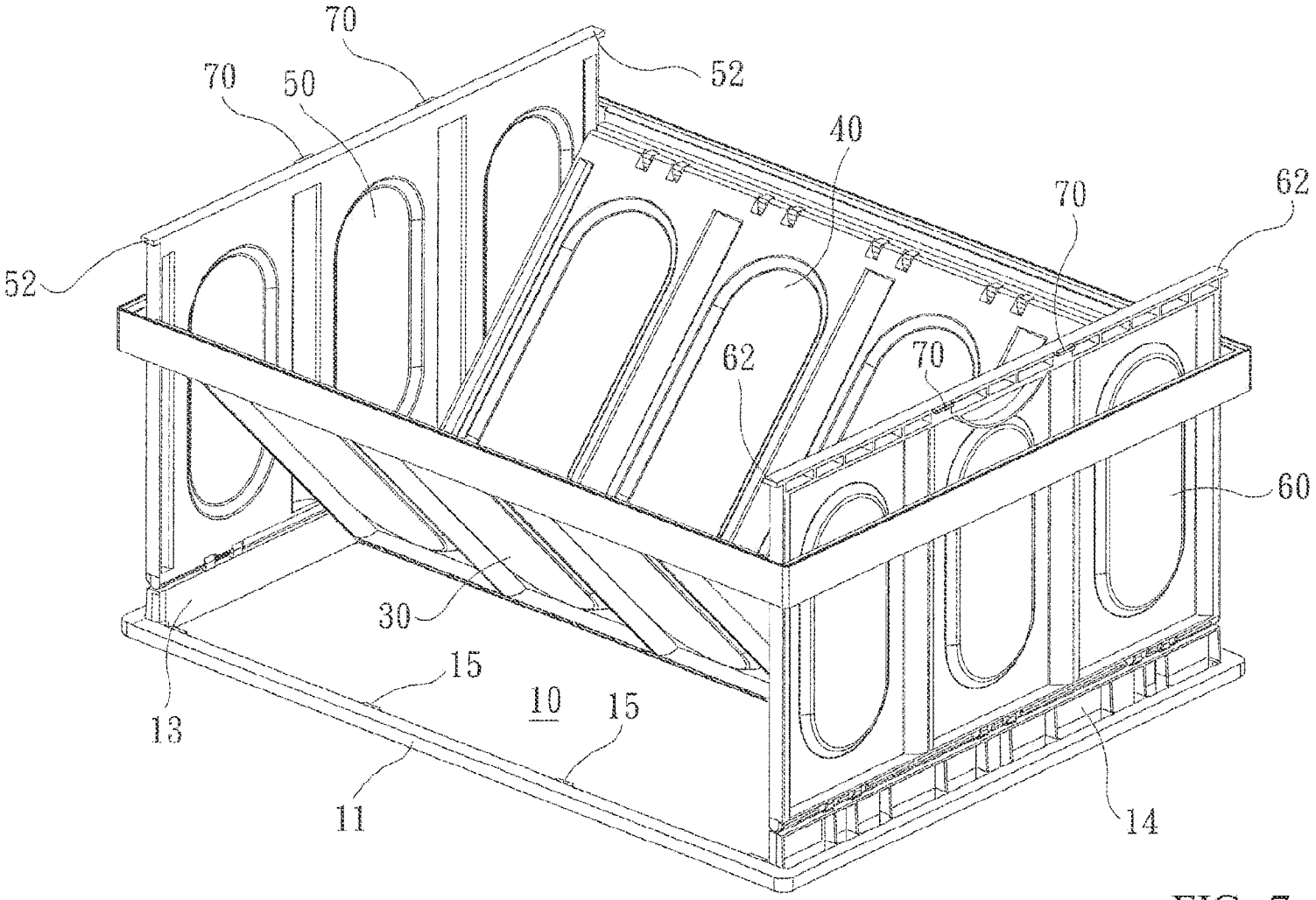
Figure 8:
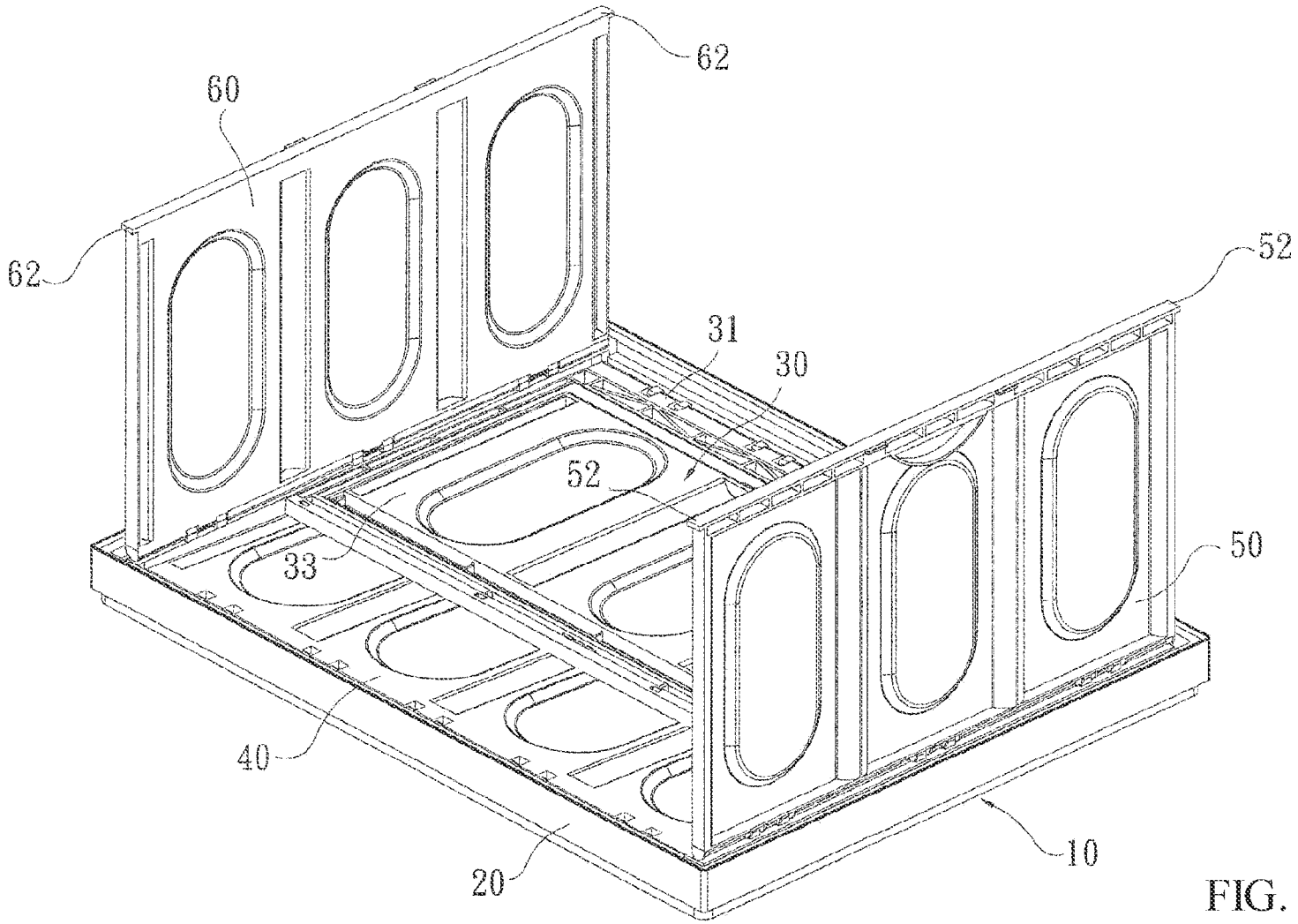

In order to fold the expanded basket as in FIG. 1 to the flat shape as in FIG. 5, the second rabbets 71 of the front wall 30 and the rear wall 40 have to be detached from the second fasteners 15 of the bottom piece 10, as shown in FIG. 6. Then, the second fasteners 70 of the left and right walls 50, 60 are detached from the second rabbets 23 of the upper frame 20, allowing the upper frame 20 to move downwards freely, as shown in FIG. 7. When the upper frame 20 descends to the bottom position, the front wall 30 and the rear wall 410 automatically lie flat, as shown in FIG. 8. At this moment, the combined height of the lying front wall 30 and the rear wall 40 is lower than the height of the third and fourth convex walls 13, 14 of the bottom piece 10. Finally, the left wall 50 and the right wall 60 rotate inwards to a lying position, completing the folding sequence, as shown in FIG. 5.

Figure 9:
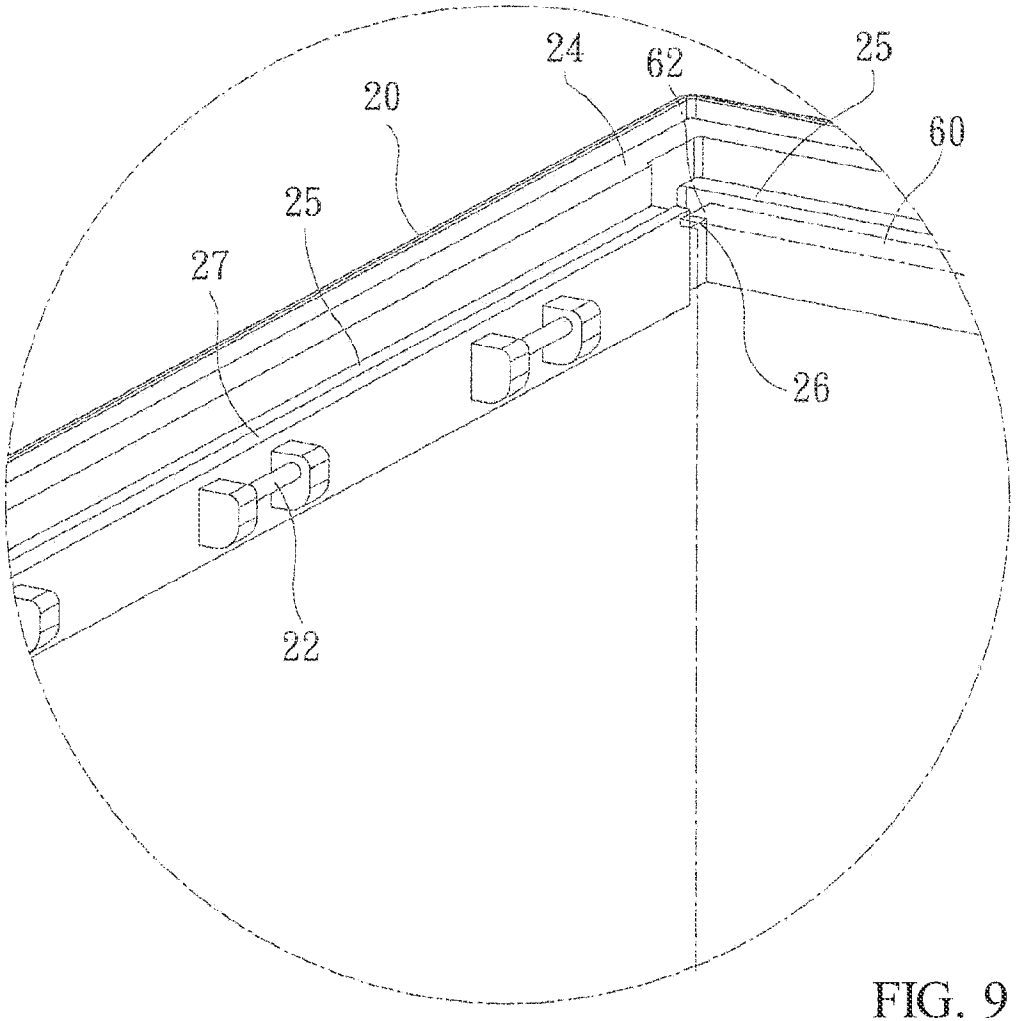
FIG. 9 is a partial enlargement of the upper frame.

See FIG. 9. There are a loop of first tread 24 and a loop of second tread 25 of different heights inside the upper frame. The second tread 25 is located inside the first tread 24. The first tread 24 is higher than the second tread 25. There are recesses 26 on both ends of the front frame bars and rear frame bars of the second tread 25. The top ends of the left wall 50 and the right wall 60 each has a protrusion 52, 62.

To expand the foldable basket, the left wall 50 and the right wall 60 have to rotate to an upright position first. Then, the upper frame 20 is moved upwards. In this step, the top end of the protrusions 52, 62 of the left wall 50 and the right wall 60 will stop at the four recesses 26 of the second tread 25 of the upper frame 20. This means the upper frame 20 has moved into place. Then, the first fasteners 70 of the left wall 50 and the right wall 60 are inserted into the first rabbets 23 of the upper frame 20. This brings the upper frame 20, the left wall 50, and the right wall 60 to their expanded positions. As the upper frame 20 moves upwards, the front wall 30 and the rear wall 40 automatically expand. This allows the lower end of the front wall 30 and the rear wall 40 to snug fit to the first convex wall 11 and the second convex wall 12 of the bottom piece 20. Subsequently, the second fasteners 71 of the front wall 30 and the rear wall 40 are inserted into the second rabbets 15 of the bottom piece 20, completing the expansion sequence.

Figure 10:
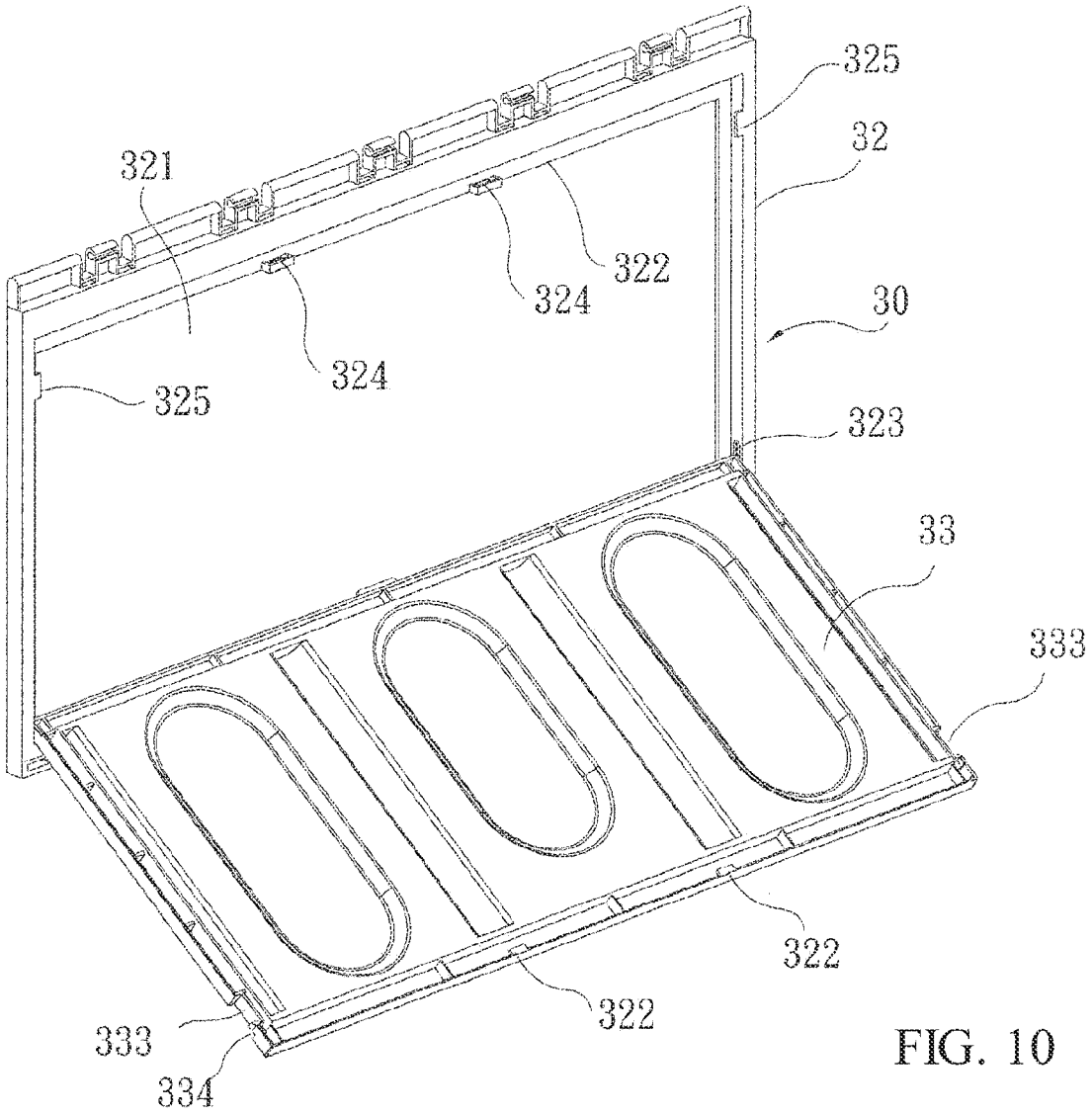
FIG. 10 is an exterior drawing of the front wall.
Figure 11:
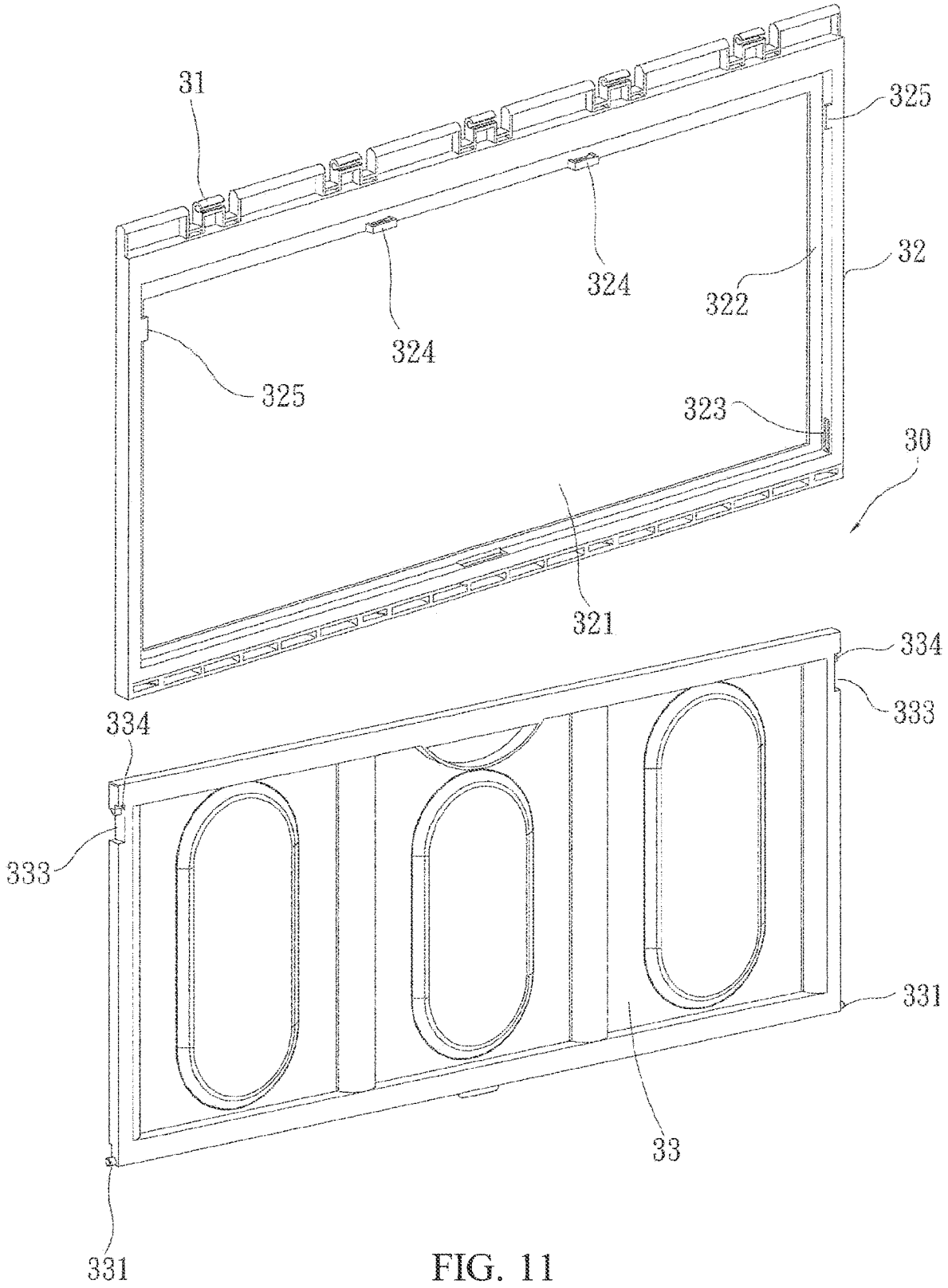
FIG. 11 is a breakdown drawing of the front wall.
Figure 12:
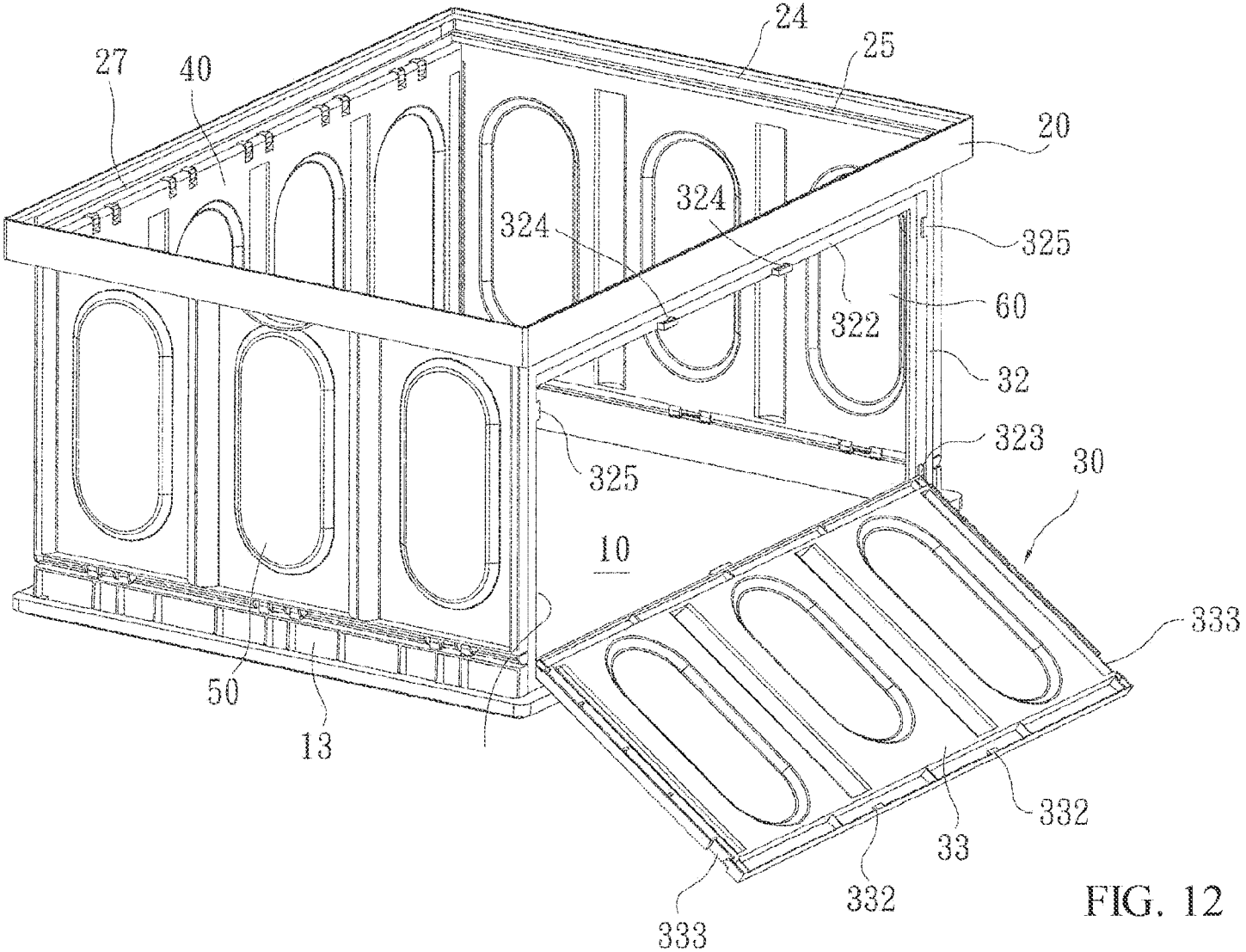
FIG. 12 demonstrates the embodiment in FIG. 1 when the door is open.

See FIGS. 10 to 12. The front wall 30 consists of one front wall frame 32 and one door 33. There is an opening 321 in the center of the front wall frame 32. The door 33 covers up the opening 321. The opening 321 on the front wall frame 32 has a doorstop 322 which holds the door 33 upright. The door 33 opens downwards to reveal the interior of the foldable basket. There is a protruding pivot 331 on each bottom end of the door 33. The central opening 321 on the front wall frame 32 has a long hole 323 on both sides. The two protruding pivots 331 of the door 33 are inserted into the long holes 323. The door 33 opens or stays upright with the two protruding pivots 331 as an axis. When upright, the door 33 covers the central opening 321 of the front wall frame 32. The door 33 opens when moving downwards. The doorstop 322 of the front wall frame 32 has two hook grooves 324. The hook grooves 324 go in a top-down direction. There are two hooks 332 inside the door 33 correspondingly. The hooks 332 are attached in a top-down manner to the hook grooves 324, locking the door 33. This covers up the central opening 321 of the front wall frame 32. The hooks 332 is detached from the hook grooves 324 by lifting the door 33 upwards. Also, the front wall frame 32 has a stopping plate 325 on the left and right sides. This stops the door 33 from opening outwards. The door 33 has corresponding recesses 333 for the stopping plates 325. The height of the recesses 333 is lower than the stopping plates 325. Lifting the door 33 upwards, the recesses 333 are aligned to the stopping plates 325, allowing the stopping plates 325 to pass through. This way, the door 33 can be opened to reveal the central opening 321 of the front wall frame 32 and the interior space of the foldable basket. There is a recess 334 on each of the two recesses 333 of the door 33. When the two stopping plates 325 stop the door 33, the two stopping plates 325 fall into the two recesses 334. This allows the front face of the door 33 and the front face of the front wall frame 32 to form a vertical face.

Figure 13:
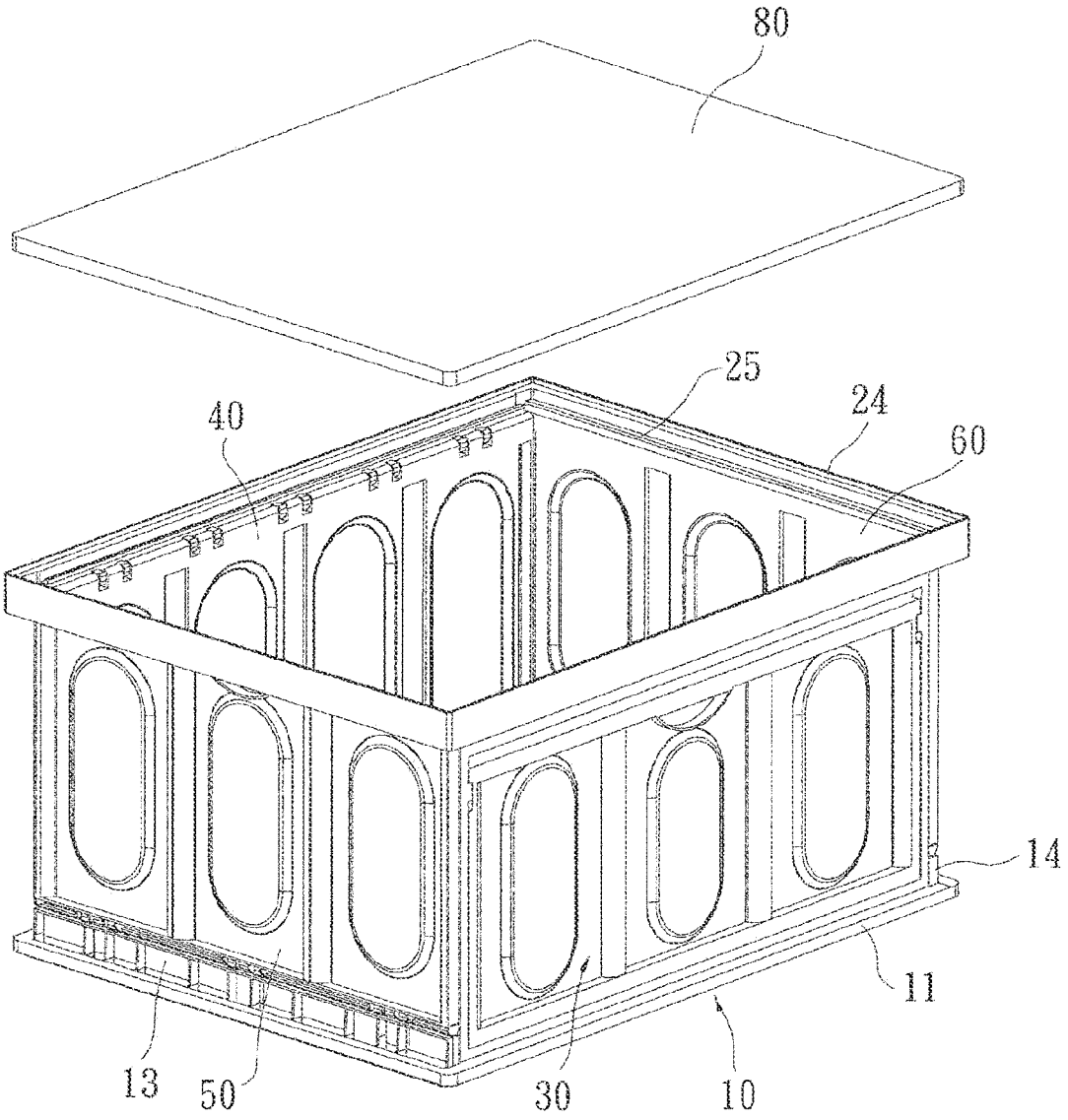
FIG. 13 demonstrates the embodiment in FIG. 1 with a cover.
Figure 14:
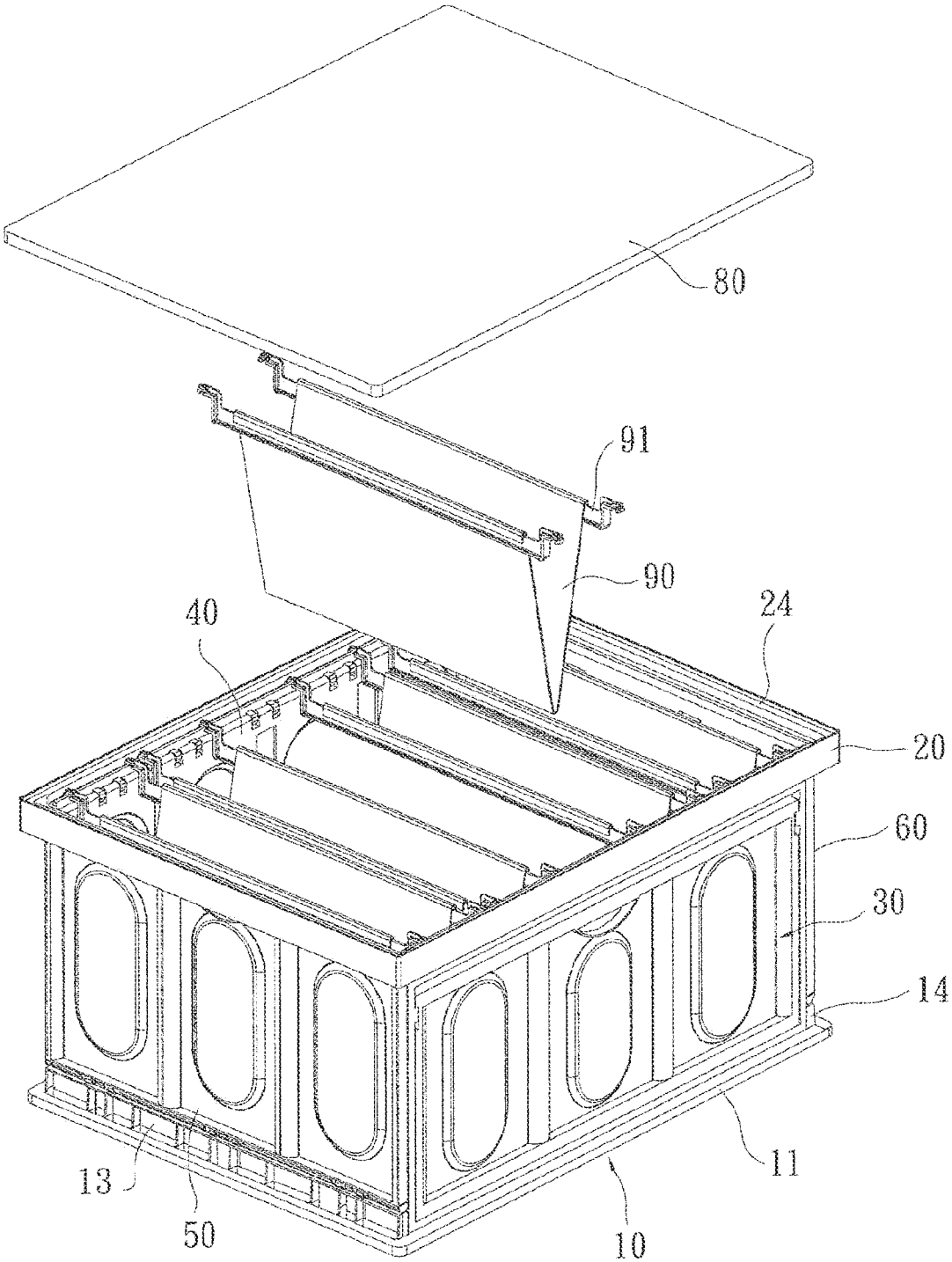
FIG. 14 demonstrates the embodiment in FIG. 1 storing folders.

Please see FIG. 13. The foldable basket has a cover 80. The cover 80 covers up the top opening of the foldable basket and is held by the first tread 24 of the upper frame 20. See FIGS. 9 and 14. Inside the second tread 25 of the front frame bar and the rear frame bar of the upper frame 20 is a bar 27 protruding upwards. A long groove is formed on the outer wall between the bar 27 and the second tread 25. A folder 90 with hanging rod 91 can be stored inside the basket by hooking one end of the rod 91 onto the long groove of the front frame bar of the upper frame 20 and the other end on the on the rear frame bar.

In conclusion, the foldable basket disclosed in this invention has a front wall 30, a rear wall 40, a left wall 50, a right wall 60. The walls are all complete panels, which leads to greater rigidity. Also, this invention has a door 33, allowing one to access items stored in the foldable basket by opening the door 33. This increases user convenience.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A foldable basket comprising:

a front wall;

a rear wall opposing to the front wall;

a left wall;

a right wall opposing to the left wall;

a bottom piece having front, rear, left, and right end portions;

a movable upper frame having front, rear, left and right frame bars positioned outside of the front, rear, left and right walls, wherein the moving upper frame is sitting on the bottom piece when the foldable basket is at a folded position; and a first convex wall located on the front end portion of the bottom piece, a second convex wall on the rear end portion of the bottom piece, a third convex wall on the left end portion of the bottom piece, and a fourth convex wall on the right end portion of the bottom piece;

wherein the first and second convex walls are oppositely placed in a first height; the third and fourth convex walls are oppositely placed in a second height, with the second height as higher than the first height;

wherein a lower end of the left wall is engaged with and pivotally connected to the third convex wall, allowing the left wall to move to an upright or lying position; and a lower end of the right wall is engaged with and pivotally connected to the fourth convex wall, allowing the right wall to move to an upright or lying position;

wherein an upper end of the front wall is pivotally connected to the upper frame, thereby allowing the front wall to move to an upright or lying position; and an the upper end of the rear wall is pivotally connected to the upper frame, thereby allowing the rear wall to move to an upright or lying position;

wherein at least one pair of first rabbets is placed on an inner surface of the left frame bar, and at least another pair of the first rabbets is placed on an inner surface of the right frame bar; correspondingly, at least one pair of first fasteners is placed on the left wall to couple with the one pair of the first rabbets, and at least another pair of the first fasteners is placed on the right wall to couple with the another pair of the first rabbets;

wherein at least one pair of second rabbets is placed on the front wall, and at least another pair of the second rabbets is placed on the rear wall; correspondingly, at least one pair of second fasteners is placed on an inner surface of the first convex wall to couple with the one pair of the second rabbets, and at least another pair of the second fasteners is placed on an inner surface of the second convex wall to couple with the another pair of the second rabbets;

wherein the front wall is comprised of a front wall frame, which has a center opening and a pair of mating holes, and a door, which has a pair of pivots at the opposing bottom ends of the door for engaging with the mating holes;

wherein the door is operable from outside of the foldable basket, and opens downward in a flat position to reveal the interior of the foldable basket, or conversely closes upward in an upright position to cover the center opening of the front wall;

wherein the front wall frame has a pair of hook grooves and a pair of stopping plates, and the door has a pair of doorstop hooks and a pair of recesses;

wherein the pair of hook grooves mates with the corresponding pair of doorstop hooks to hold and lock the door in the upright position, and the pair of stopping plates mates with the corresponding pair of recesses to stop the door from moving outwards; and wherein the pair of recesses is aligned with the pair of stopping plates when the door is lifted upward, allowing the pair of stopping plates to pass through.

2. The foldable basket according to claim 1, wherein the pair of stopping plates correspondingly falls on the pair of recesses in the door, allowing the front face of the door and the front face of the front wall frame to form a vertical face.

3. The foldable basket according to claim 1, wherein a first tread and a second tread are of different heights and located inside the upper frame, with the first tread being higher than the second tread recesses.

4. The foldable basket according to claim 3, wherein the left wall and the right wall each has a protrusion; and as the upper frame moves upwards, the protrusions of the left wall and the right wall engage with at the recesses of the second tread.

5. The foldable basket according to claim 4, wherein a protruding bar is inside the second tread of the front frame bar and the rear frame bar of the upper frame; and a long groove is formed on the outer wall between the protruding bar and the second tread.

6. The foldable basket according to claim 1, wherein the front, rear, left and right walls each includes one or more oval hallow sections.

7. A foldable basket comprising:

a front wall opposing a rear wall, a left wall opposing a right wall, and a bottom piece having front, rear, left and right end portions;

a movable upper frame having front, rear, left and right frame bars positioned outside of the front, rear, left and right walls, and sitting on the front, rear, left and right end portions when the foldable basket is at a folded position;

a first convex wall located on the front end portion of the bottom piece, a second convex wall located on the rear end portion of the bottom piece, a third convex wall located on the left end portion of the bottom piece, and a fourth convex wall located on the right end portion of the bottom piece;

wherein the first and second convex walls are oppositely placed in a first height; the third and fourth convex walls are oppositely placed in a second height, with the second height as higher than the first height;

wherein a lower end of the left wall is engaged with and pivotally connected to the third convex wall, allowing the left wall to move to an upright or lying position when pivoted around an axis; and a lower end of the right wall is engaged with and pivotally connected to the fourth convex wall, allowing the right wall to move to an upright or lying position when pivoted;

wherein an upper end of the front wall is pivotally connected to the upper frame for allowing the front wall to move to an upright or lying position; and an the upper end of the rear wall is pivotally connected to the upper frame, thereby allowing the rear wall to move to an upright or lying position;

wherein at least one pair of first rabbets is placed on an inner surface of the left frame bar, and at least another pair of the first rabbets is placed on an inner surface of the right frame bar; correspondingly, at least one pair of first fasteners is placed on the left wall to couple with the one pair of the first rabbets, and at least another pair of the first fasteners is placed on the right wall to couple with the another pair of the first rabbets;

wherein at least one pair of second rabbets is placed on the front wall, and at least another pair of the second rabbets is placed on the rear wall; correspondingly, at least one pair of second fasteners is placed on an inner surface of the first convex wall to couple with the one pair of the second rabbets, and at least another pair of the second fasteners is placed on an inner surface of the second convex wall to couple with the another pair of the second rabbets; and wherein a first tread and a second tread are of different heights and located inside the upper frame, with the first tread being higher than the second tread.

8. The foldable basket according to claim 7, wherein the left wall and the right wall each has a protrusion; and as the upper frame moves upwards, the protrusions of the left wall and the right wall engage with at the recesses of the second tread.

9. The foldable basket according to claim 7, wherein a protruding bar is inside the second tread of the front frame bar and the rear frame bar of the upper frame; and a long groove is formed on the outer wall between the protruding bar and the second tread.

* * * * *